US006932161B2

(12) United States Patent
Cameron

(10) Patent No.: US 6,932,161 B2
(45) Date of Patent: Aug. 23, 2005

(54) PROFILED ENCAPSULATION FOR USE WITH INSTRUMENTED EXPANDABLE TUBULAR COMPLETIONS

(75) Inventor: John A. M. Cameron, Kemnay (GB)

(73) Assignee: Weatherford/Lams, Inc., Houston, TX (US)

( * ) Notice: Subject to any disclaimer, the term of this patent is extended or adjusted under 35 U.S.C. 154(b) by 246 days.

(21) Appl. No.: 09/964,160

(22) Filed: Sep. 26, 2001

(65) Prior Publication Data

US 2003/0056948 A1 Mar. 27, 2003

(51) Int. Cl.[7] ..... E21B 43/10

(52) U.S. Cl. ..... 166/384; 166/385; 166/242.1; 166/65.1; 166/206

(58) Field of Search ..... 166/65.1, 66, 206, 166/207, 242.1, 384, 385

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | |
| 1,981,525 | A | 11/1934 | Price | 166/4 |
| 2,214,226 | A | 9/1940 | English | 166/1 |
| 2,383,214 | A | 8/1945 | Prout | 153/82 |
| 2,499,630 | A | 3/1950 | Clark | 153/81 |
| 2,627,891 | A | 2/1953 | Clark | 153/82 |
| 2,663,073 | A | 12/1953 | Bieber et al. | 29/148 |
| 2,898,971 | A | 8/1959 | Hempel | 153/82 |
| 3,087,546 | A | 4/1963 | Wooley | 166/46 |
| 3,191,677 | A | 6/1965 | Kinley | 166/14 |
| 3,195,646 | A | 7/1965 | Brown | 166/208 |
| 3,467,180 | A | 9/1969 | Pensotti | 165/180 |
| 3,712,376 | A | 1/1973 | Owen et al. | 166/277 |
| 3,776,307 | A | 12/1973 | Young | 166/125 |
| 3,818,734 | A | 6/1974 | Bateman | 72/75 |
| 3,844,345 | A | 10/1974 | Evans et al. | 166/72 |
| 3,911,707 | A | 10/1975 | Minakov et al. | 72/76 |
| 3,948,321 | A | 4/1976 | Owen et al. | 166/277 |

(Continued)

FOREIGN PATENT DOCUMENTS

| | | | |
|---|---|---|---|
| EP | 0 651 130 A2 | 5/1995 | E21B/33/127 |
| EP | 0 961 007 | 12/1999 | E21B/33/10 |

(Continued)

OTHER PUBLICATIONS

PCT Written Opinion, International Application No. PCT/GB02/04303, dated May 28, 2003.
PCT International Search Report, International Application No. PCT/GB 02/04303, dated Nov. 21, 2002.

(Continued)

*Primary Examiner*—David Bagnell
*Assistant Examiner*—Shane Bomar
(74) *Attorney, Agent, or Firm*—Moser, Patterson & Sheridan, L.L.P.

(57) ABSTRACT

The present invention provides an encapsulation for housing instrumentation lines, control lines, or instruments downhole. In one use, the encapsulation resides between an expandable downhole tool, such as an expandable sand screen, and the wall of the wellbore. The encapsulation is specially profiled to allow the downhole tool to be expanded into the wall of the wellbore without leaving a channel outside of the tool through which formation fluids might vertically migrate. The encapsulation is useful in both cased hole and open hole completions.

11 Claims, 4 Drawing Sheets

U.S. PATENT DOCUMENTS

| | | | | |
|---|---|---|---|---|
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,429,620 | A | 2/1984 | Burkhardt et al. | 91/395 |
| 4,444,403 | A | 4/1984 | Morris | 277/228 |
| 4,531,581 | A | 7/1985 | Pringle et al. | 166/120 |
| 4,569,392 | A | 2/1986 | Peterman | 166/242 |
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 5,052,483 | A | 10/1991 | Hudson | 166/55 |
| 5,161,613 | A | 11/1992 | Jones | |
| 5,271,472 | A | 12/1993 | Leturno | 175/107 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,542,472 | A | 8/1996 | Pringle et al. | |
| 5,560,426 | A | 10/1996 | Trahan et al. | 166/120 |
| 5,685,369 | A | 11/1997 | Ellis et al. | 166/195 |
| 5,901,787 | A | 5/1999 | Boyle | 166/135 |
| 5,901,789 | A | 5/1999 | Donnelly et al. | |
| 5,962,819 | A | 10/1999 | Paulsson | |
| 6,021,850 | A | 2/2000 | Wood et al. | 166/380 |
| 6,029,748 | A | 2/2000 | Forsyth et al. | 166/380 |
| 6,098,717 | A | 8/2000 | Bailey et al. | 166/382 |
| 6,173,788 | B1 | 1/2001 | Lembcke et al. | 166/387 |
| 6,196,766 | B1 | 3/2001 | Graham | |
| 6,206,133 | B1 | 3/2001 | Paulsson | |
| 6,237,687 | B1 | 5/2001 | Barbee, Jr. et al. | |
| 6,446,723 | B1 * | 9/2002 | Ramos et al. | 166/65.1 |
| 6,457,518 | B1 * | 10/2002 | Castano-Mears et al. | 166/207 |
| 6,513,599 | B1 | 2/2003 | Bixenman et al. | |
| 6,554,064 | B1 | 4/2003 | Restarick et al. | |
| 6,585,053 | B2 | 7/2003 | Coon | |
| 6,591,905 | B2 | 7/2003 | Coon | |
| 6,752,216 | B2 | 6/2004 | Coon | |
| 6,766,857 | B2 | 7/2004 | Bixenman et al. | |
| 6,805,202 | B2 | 10/2004 | Gillespie et al. | |
| 2001/0030076 | A1 * | 10/2001 | Paulsson | 166/206 |
| 2001/0047871 | A1 | 12/2001 | Johnson et al. | |
| 2002/0053439 | A1 | 5/2002 | Danos | 166/380 |
| 2002/0088744 | A1 | 7/2002 | Echols et al. | |
| 2002/0092649 | A1 | 7/2002 | Bixenman et al. | 166/278 |
| 2002/0104655 | A1 | 8/2002 | Hurst et al. | |
| 2002/0125009 | A1 | 9/2002 | Wetzel et al. | |
| 2003/0042022 | A1 | 3/2003 | Lauritzen et al. | |

FOREIGN PATENT DOCUMENTS

| | | | |
|---|---|---|---|
| GB | 2 216 926 | 10/1989 | E21B/7/20 |
| GB | 2 320 734 | 7/1998 | E21B/33/127 |
| GB | 2 329 918 | 4/1999 | E21B/43/10 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |
| WO | WO 00/75933 | 12/2000 | H01B/7/04 |
| WO | WO 01/29368 A1 | 4/2001 | E21B/34/14 |
| WO | WO 02/055841 A2 | 7/2002 | E21B/43/00 |

OTHER PUBLICATIONS

U.S. Appl. No. 09/990,092, filed Nov. 21, 2001, Simpson, et al.
U.S. Appl. No. 09/964,034, filed Sep. 26, 2001, Cameron.
U.S. Appl. No. 09/904,735, filed Jul. 13, 2001, Badrak, et al.
U.S. Appl. No. 09/885,850, filed Jun. 20, 2001, Lauritzen, et al.
U.S. Appl. No. 09/849,624, filed May 04, 2001, Bode, et al.
U.S. Appl. No. 09/848,900, filed May 04, 2001, Haugen, et al.
U.S. Appl. No. 09/818,119, filed Mar. 27, 2001, Lauritzen.
U.S. Appl. No. 09/470,176, filed Dec. 22, 1999, Metcalfe, et al.
U.S. Appl. No. 09/470,154, filed Dec. 22, 1999, Metcalfe, et al.
U.S. Appl. No. 09/469,692, filed Dec. 22, 1999, Trahan.
U.S. Appl. No. 09/469,690, filed Dec. 22, 1999, Simpson.
U.S. Appl. No. 09/469,681, filed Dec. 22, 1999, Metcalfe, et al.
U.S. Appl. No. 09/469,643, filed Dec. 22, 1999, Metcalfe, et al.
U.S. Appl. No. 09/469,526, filed Dec. 22, 1999, Metcalfe, et al.

* cited by examiner

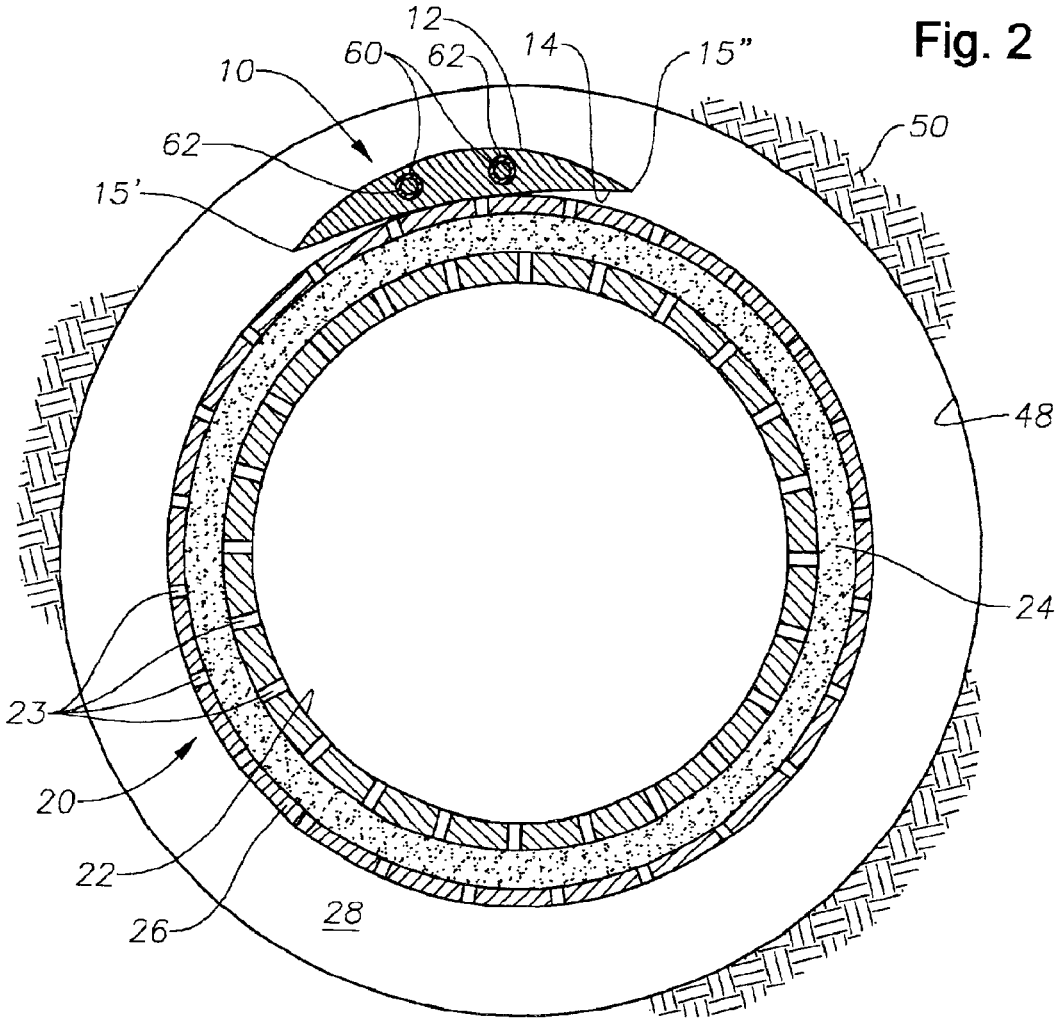
Fig. 2
Fig. 3
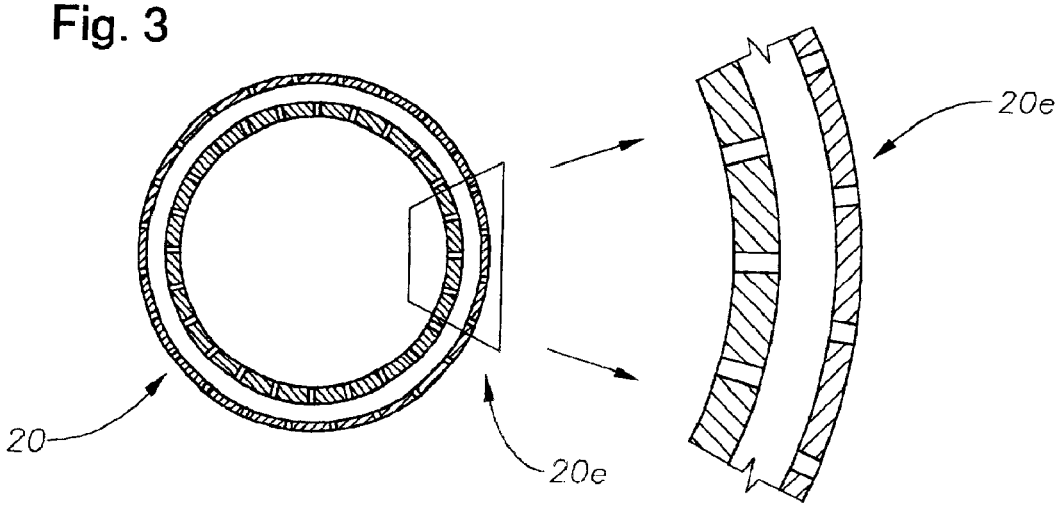

PROFILED ENCAPSULATION FOR USE WITH INSTRUMENTED EXPANDABLE TUBULAR COMPLETIONS

BACKGROUND OF THE INVENTION

1. Field of the Invention

The present invention relates to expandable sand screens and other expandable tubulars. More particularly, the present invention relates to a profiled encapsulation for use with an expandable sand screen or other expandable downhole apparatus. The profiled encapsulation houses instrumentation lines or control lines in a wellbore.

2. Description of Related Art

Hydrocarbon wells are typically formed with a central wellbore that is supported by steel casing. The steel casing lines the borehole formed in the earth during the drilling process. This creates an annular area between the casing and the borehole, which is filled with cement to further support and form the wellbore.

Some wells are produced by perforating the casing of the wellbore at selected depths where hydrocarbons are found. Hydrocarbons migrate from the formation, through the perforations, and into the cased wellbore. In some instances, a lower portion of a wellbore is left open, that is, it is not lined with casing. This is known as an open hole completion. In that instance, hydrocarbons in an adjacent formation migrate directly into the wellbore where they are subsequently raised to the surface, possibly through an artificial lift system.

Open hole completions carry the potential of higher production than a cased hole completion. They are frequently utilized in connection with horizontally drilled boreholes. However, open hole completions present various risks concerning the integrity of the open wellbore. In that respect, an open hole leaves aggregate material, including sand, free to invade the wellbore. Sand production can result in premature failure of artificial lift and other downhole and surface equipment. Sand can build up in the casing and tubing to obstruct well flow. Particles can compact and erode surrounding formations to cause liner and casing failures. In addition, produced sand becomes difficult to handle and dispose at the surface. Ultimately, open holes carry the risk of complete collapse of the formation into the wellbore.

To control particle flow from unconsolidated formations, well screens are often employed downhole along the uncased portion of the wellbore. One form of well screen recently developed is the expandable sand screen, designated by the Assignee as ESS®. In general, the ESS is constructed from three composite layers, including a filter media. The filter media allows hydrocarbons to invade the wellbore, but filters sand and other unwanted particles from entering. The sand screen is connected to production tubing at an upper end and the hydrocarbons travel to the surface of the well via the tubing. The sand screen is expanded downhole against the adjacent formation in order to preserve the integrity of the formation during production.

A more particular description of an expandable sand screen is described in U.S. Pat. No. 5,901,789, which is incorporated by reference herein in its entirety. That patent describes an expandable sand screen which consists of a perforated base pipe, a woven filtering material, and a protective, perforated outer shroud. Both the base pipe and the outer shroud are expandable, and the woven filter is typically arranged over the base pipe in sheets that partially cover one another and slide across one another as the sand screen is expanded, or is expanded directly. The expanded tubular or tool can then be expanded by a cone-shaped object urged along its inner bore or by an expander tool having radially outward extending rollers that are fluid powered from a tubular string. Using expansion means like these, the expandable tubular or tool is subjected to outwardly radial forces that urge the expanding walls against the open formation or parent casing. The expandable components are stretched past their elastic limit, thereby increasing the inner and outer diameter of the tubular.

A major advantage to the use of expandable sand screen in an open wellbore like the one described herein is that once expanded, the annular area between the screen and the wellbore is mostly eliminated, and with it the need for a gravel pack. Typically, the ESS or other solid expandable tubular is expanded to a point where its outer wall places a stress on the wall of the wellbore, thereby providing support to the walls of the wellbore to prevent dislocation of particles. Solid expandable tubulars are oftentimes used in conjunction with an expandable sand screen to provide a zonal isolation capability.

In modern well completions, the operator oftentimes wishes to employ downhole tools or instruments. These include sliding sleeves, submersible electrical pumps, downhole chokes, and various sensing devices. These devices are controlled from the surface via hydraulic control lines, electrical control lines, mechanical control lines, fiber optics and/or a combination thereof. For example, the operator may wish to place a series of pressure and/or temperature sensors every ten meters within a portion of the hole, connected by a fiber optic control line. This line would extend into that portion of the wellbore where an expandable sand screen or other solid expandable tubular or tool has been placed.

In order to protect the control lines or instrumentation lines, the lines are typically placed into small metal tubings which are affixed external to the expandable tubular and the production tubing within the wellbore. In addition, in completions utilizing known non-expandable gravel packs, the control lines have been housed within a metallic rectangular cross-sectioned container. However, this method of housing control lines or instrumentation downhole is not feasible in the context of the new, expandable completions now being offered.

First, the presence of control lines behind an expandable tubular interferes with an important function, which is to provide a close fit between the outside surface of the expandable tubular, and the formation wall. The absence of a close fit between the outside surface of the expandable tubular and the formation wall creates a vertical channel outside of the tubular, allowing formation fluids to migrate between formations therein. This, in turn, causes inaccurate pressure, temperature, or other readings from downhole instrumentation, particularly when the well is shut in for a period of time, or may provide a channel for erosive wear.

There is a need, therefore, for an encapsulation for control lines or instrumentation lines which is not rectangular in shape, but is profiled so as to allow a close fit between an expandable tubular and a formation wall or parent casing. There is further a need for an encapsulation which resides between the outside surface of an expandable and the formation wall, and which does not leave a vertical channel outside of the expandable tubular when it is expanded against the formation wall. Still further, there is a need for such an encapsulation device which is durable enough to withstand abrasions incurred while being run into the wellbore, but which is sufficiently deformable as to be deformed in arcuate fashion as to closely reside between an expanded tubular and the wall of a wellbore, whether cased or open.

SUMMARY OF THE INVENTION

The present invention provides an encapsulation for housing instrumentation lines, control lines, or instruments downhole. In one use, the encapsulation resides between an expandable downhole tool, such as an expandable sand screen, and the wall of the wellbore. The encapsulation is specially profiled to allow the downhole tool, e.g., ESS, to be expanded into the wall of the wellbore without leaving a channel outside of the tool through which formation fluids might vertically migrate. The encapsulation is useful in both cased hole and open hole completions. The profile is generally derived from the bore hole i.d. (or parent casing i.d.) and the o.d. of the expanded tubular.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 2 is a top section view of an expandable sand screen completion within an open wellbore. The sand screen is in its unexpanded state. Visible is a top view of a profiled encapsulation of the present invention residing in the sand screen-formation annulus.

FIG. 3 is a top section view of an expandable sand screen before expansion, and a blow-up view of a portion of the expandable sand screen.

DETAILED DESCRIPTION OF THE PREFERRED EMBODIMENT

Figure 1:
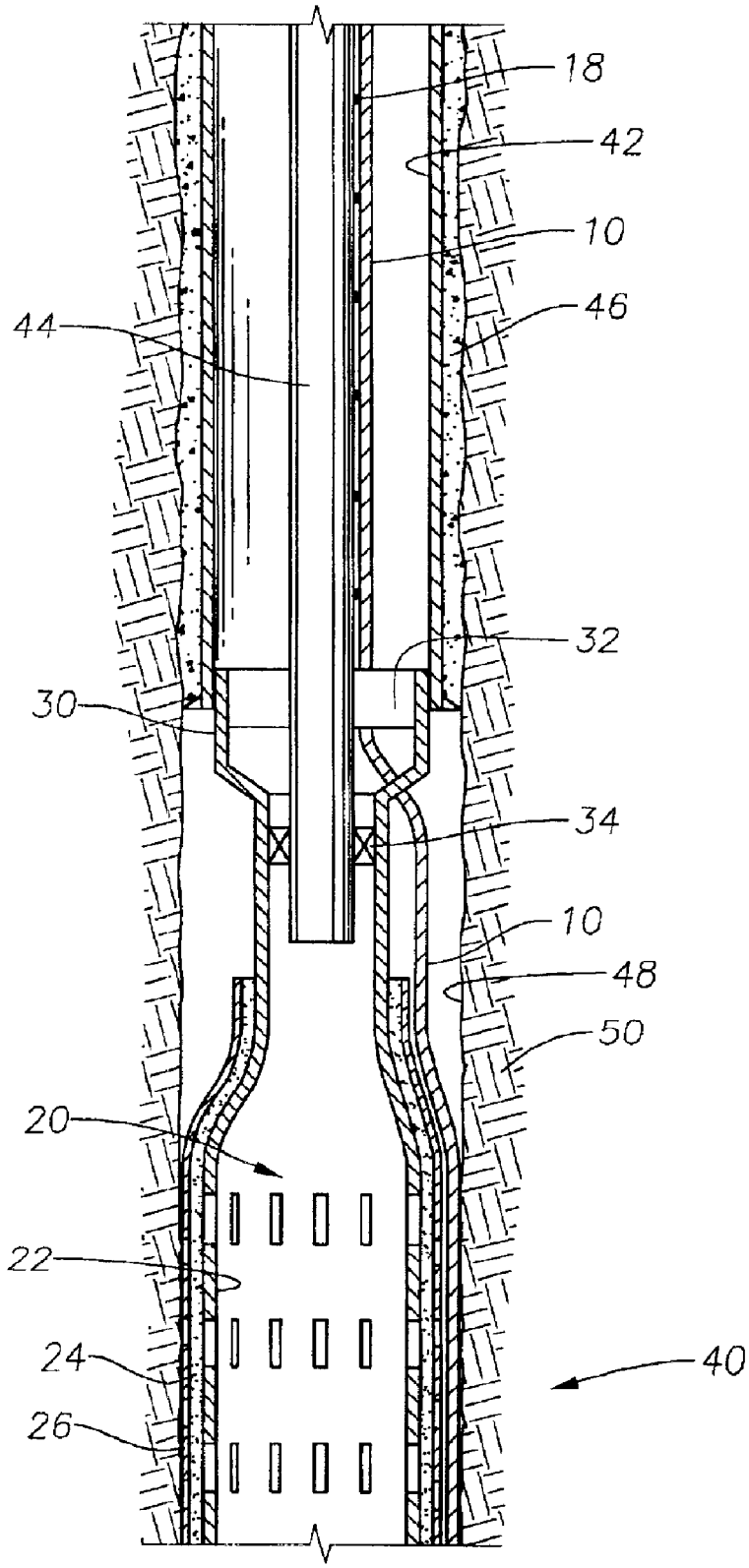
FIG. 1 is a section view showing an open hole wellbore with a typical expandable sand screen and tubulars disposed therein. A profiled encapsulation of the present invention is shown in cross-section running from the surface to the depth of the expandable completion.

FIG. 1 is a section view showing an open hole wellbore 40. The wellbore 40 includes a central wellbore which is lined with casing 42. The annular area between the casing 42 and the earth is filled with cement 46 as is typical in well completion. Extending downward from the central wellbore is an open hole wellbore 48. A formation 50 is shown adjacent the wellbore 48.

Disposed in the open wellbore 48 is a downhole tool 20 to be expanded. In the embodiment shown in FIG. 1, the tool 20 is an expandable sand screen (ESS®). However, the tool 20 could be any expandable downhole apparatus. An ESS 20 is hung within the wellbore 40 from a hanging apparatus 32. In some instances, the hanging apparatus is a packer (not shown). In the depiction of FIG. 1, the hanging apparatus is a liner 30 and liner hanger 32. A separate packer 34 may be employed to seal the annulus between the liner 30 and the production tubular 44.

Also depicted in FIG. 1 is an encapsulation 10 of the present invention. The encapsulation 10 is shown running from the surface to the liner hanger 32. The encapsulation 10 is secured to the production tubular 44 by clamps, shown schematically at 18. Clamps 18 are typically secured to the production tubular 44 approximately every ten meters. The clamps 18 are designed to expand with the tool 20 when it is expanded. The encapsulation 10 passes through the liner hanger 32 (or utilized hanging apparatus), and extends downward to a designated depth within the wellbore 40. In the embodiment shown in FIG. 1, the encapsulation 10 extends into the annular region (shown as 28 in FIG. 2) between the expandable sand screen 20 and the open hole wellbore 48. Note that the expandable sand screen 20 of FIG. 1 has already been expanded against the open hole formation 50 so that no annular region remains. The ESS 20 is thus in position for production of hydrocarbons.

FIG. 2 presents a top section view of an encapsulation 10 of the present invention. The encapsulation 10 resides in this depiction within an open hole wellbore 48. As in FIG. 1, the encapsulation 10 is disposed in the annular region 28 defined by the expandable sand screen 20 and the formation wall 48. The encapsulation 10 is designed to serve as a housing for control lines or instrumentation lines 62 or control instrumentation (not shown). For purposes of this application, such lines 62 include any type of data acquisition lines, communication lines, fiber optics, cables, sensors, and downhole "smart well" features. The encapsulation 10 may optionally also house metal tubulars 60 for holding such control or instrumentation lines 62.

The encapsulation 10 is specially profiled to closely fit between the sand screen 20 and the surrounding formation wall 48 after the sand screen 20 has been expanded. In this way, no vertical channel is left within the annular region 28 after the sand screen 20 is been expanded. To accomplish this, an arcuate configuration is employed for the encapsulation 20 whereby at least one of the walls 12 and 14 is arcuate in shape. In the preferred embodiment shown in FIG. 2, both walls 12 and 14 are arcuate such that a crescent-shape profile is defined. Thus, the encapsulation 10 shown in FIG. 2 comprises a first arcuate wall 12 and a second arcuate wall 14 sharing a first end 15' and a second end 15". However, it is only necessary that the outside wall 12 be arcuate in design.

The encapsulation 10 is normally fabricated from a thermoplastic material which is durable enough to withstand abrasions while being run into the wellbore 40. At the same time, the encapsulation 10 material must be sufficiently malleable to allow the encapsulation to generally deform to the contour of the wellbore 48. This prevents annular flow behind the sand screen 20. The encapsulation 10 is preferably clamped to the expandable tubular 20 by expandable clamps (not shown). The expandable clamps are designed to provide minimal restriction to the tubular i.d.

In FIG. 2, the sand screen 20 is in its unexpanded state. In the embodiment of FIG. 2, the sand screen 20 is constructed from three composite layers. These define a slotted structural base pipe 22, a layer of filter media 24, and an outer encapsulating and protecting shroud 26. Both the base pipe 22 and the outer shroud 26 are configured to permit hydrocarbons to flow therethrough, such as through slots (e.g., 23) or perforations formed therein. The filter material 24 is held between the base pipe 22 and the outer shroud 26, and serves to filter sand and other particulates from entering the sand screen 20 and the production tubular 44. The sand screen 20 typically is manufactured in sections which can be joined end-to-end at the well-site during downhole completion. It is within the scope of this invention to employ an encapsulation 10 with one or more sections of expandable sand screen 20 or other expandable downhole tool.

Figure 4:
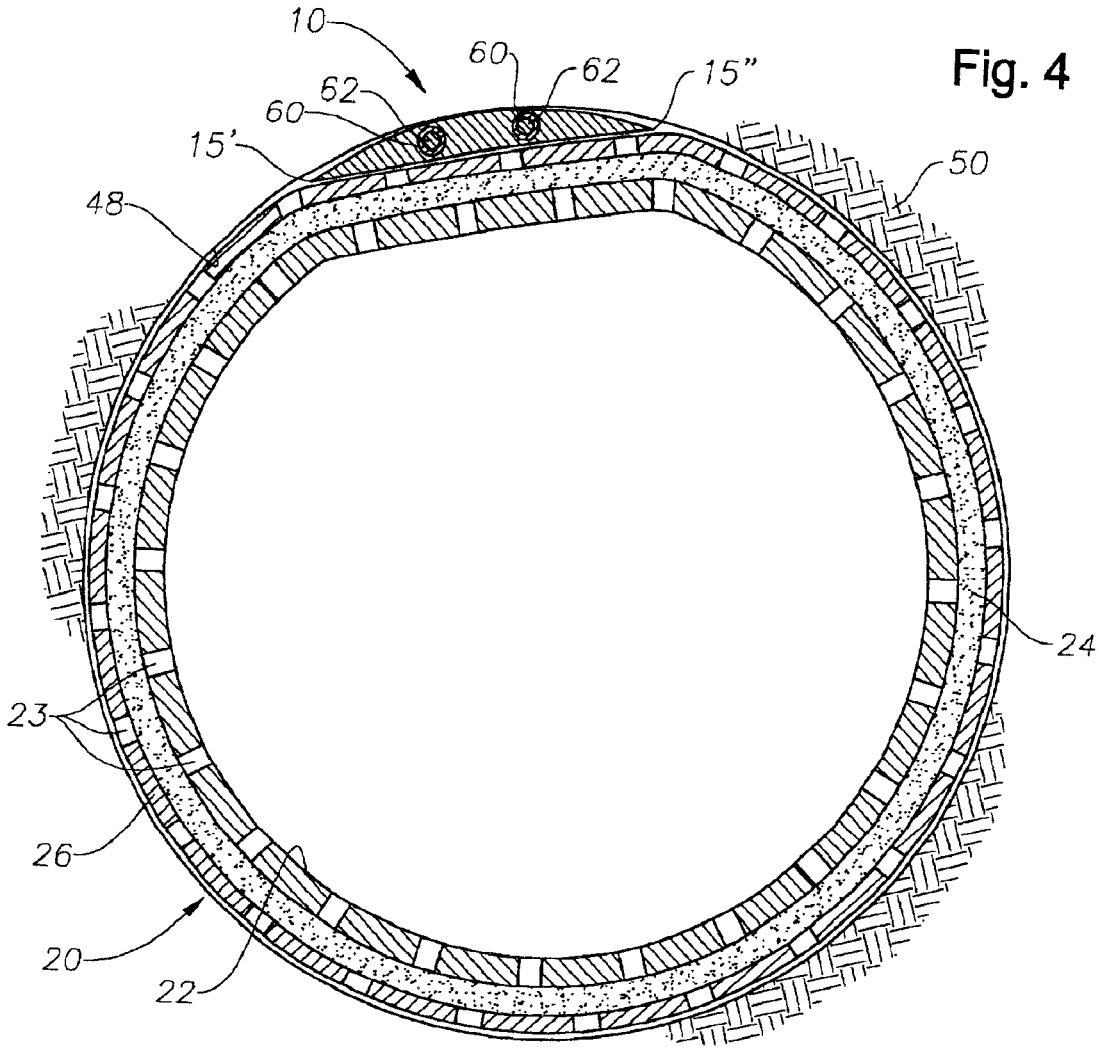
FIG. 4 is a top section view of an expandable sand screen within an open wellbore. The sand screen is in its expanded state. Visible is a top view of a profiled encapsulation of the present invention residing in the sand screen-formation annulus.

In FIG. 3, the sand screen 20 is again shown in cross-section. A portion 20*e* of the sand screen 20 is shown in an expanded state, to demonstrate that the sand screen 20 remains sand tight after expansion. (Note that the expanded depiction is not to scale.) Radial force applied to the inner wall of the base pipe 22 forces the pipe 22 past its elastic limits and also expands the diameter of the base pipe perforations 23. Also expanded is the shroud 26. As shown in FIG. 4, the shroud 26 is expanded to a point of contact with the wellbore 48. Substantial contact between the sand screen 20 and the wellbore wall 48 places a slight stress on the formation 50, reducing the risk of particulate matter entering the wellbore 48. It also reduces the risk of vertical fluid flow behind the sand screen 20.

FIG. 4 is a top section view illustrating the wellbore 48 and the sand screen 20 expanded therein. Expansion is within the open wellbore 48 of FIG. 2. Visible is the top view of a profiled encapsulation of the present invention residing in the sand screen-formation annulus 28 (shown in FIG. 3). The encapsulation 10 has been expanded by a conformed cone or roller apparatus or other expander tool (not shown) to provide a close fit between the sand screen 20 and the formation 48 such that no annular region 28 remains as would permit measurable vertical fluid movement behind the sand screen 20.

Figure 5:
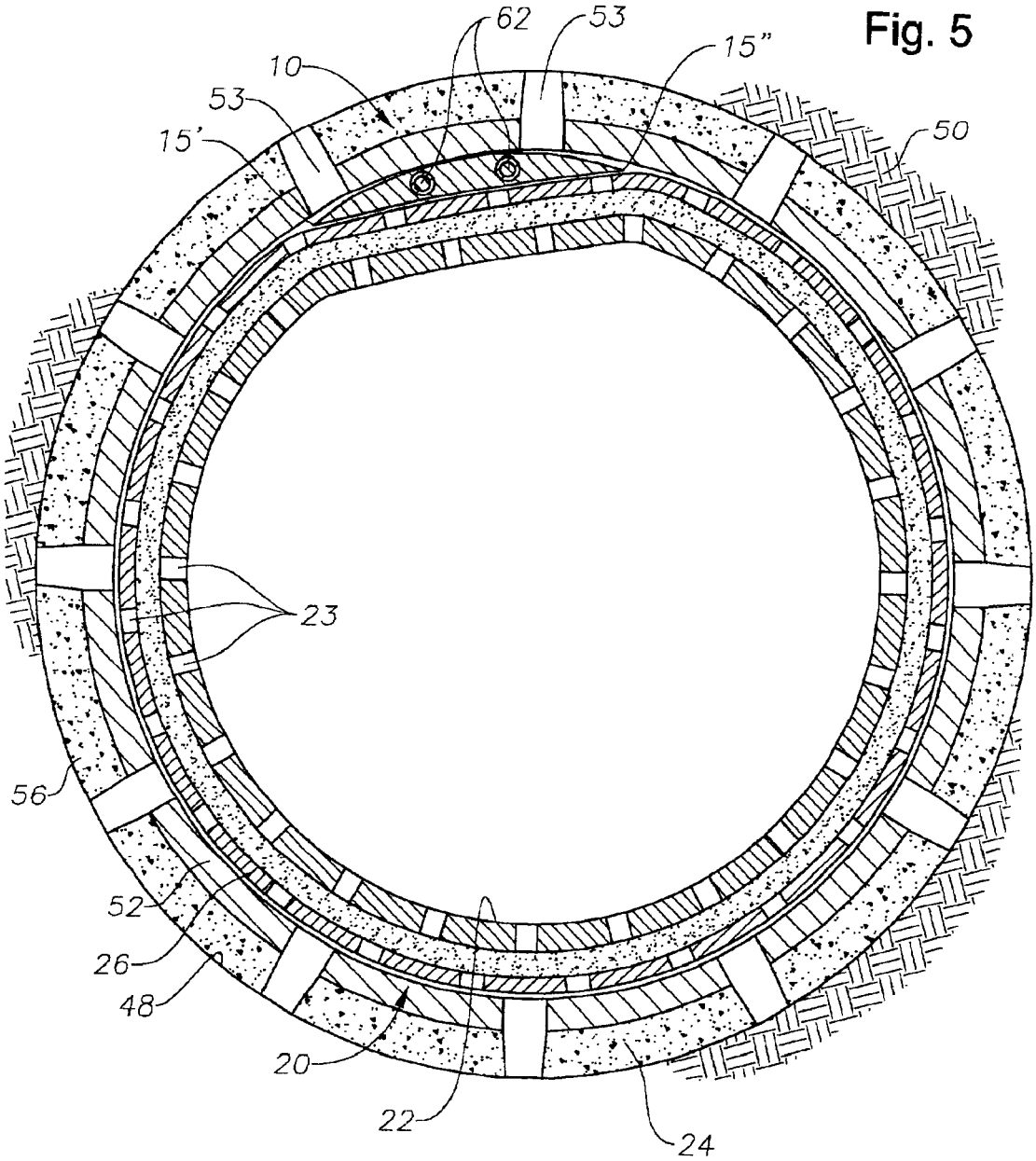
FIG. 5 depicts the expandable sand screen of FIG. 4, expanded against a cased hole wellbore.

FIG. 5 depicts an expandable sand screen 20 expanded against a cased hole wellbore. Casing is shown as 52, and the cement is shown as 56. The casing 52 is perforated 53 to allow hydrocarbons to pass into and through the sand screen 20. This demonstrates that the encapsulation 10 of the present invention has application to a cased hole completion as well as an open hole completion. Those of ordinary skill in the art will appreciate that hydrocarbons will enter the casing through perforations 53.

While the foregoing is directed to embodiments of the present invention, other and further embodiments of the invention may be devised without departing from the basic scope thereof, and the scope thereof is determined by the claims that follow.

What is claimed is:

1. An expandable downhole tool, comprising:

a bass pipe;

a shroud concentrically disposed about the base pipe;

a filter media disposed between the base pipe and the shroud; and an enclosed line housing disposed on the outer surface of the shroud, wherein the enclosed line housing is deformable upon expansion of the downhole tool.

2. The expandable tool of claim 1, wherein the shroud is perforated.

3. The expandable tool of claim 1, wherein the enclosed line housing is axially disposed along a length of the shroud.

4. The expandable tool of claim 1, wherein the enclosed line housing defines an arcuate outer surface having a radius of curvature substantially equal to that of the shroud.

5. The expandable downhole tool of claim 1, further comprising a line disposed in the enclosed line housing, the line being configured for propagation of a signal.

6. The expandable tool of claim 5, wherein the line is selected from one of a control line and a data line.

7. The expandable downhole tool of claim 1, wherein the enclosed line housing is disposable between the shroud and a wall of a wellbore.

8. An apparatus for use in a wellbore, comprising:

an expandable tubular;

a control line connected to the outer diameter of the expandable tubular; and a controller communicating with the control line, wherein the control line is disposed within a housing which provides a substantially sealed annulus between the expandable tubular and the wellbore.

9. The apparatus of claim 8, wherein the control line is a fiber optic line.

10. A method of protecting one or more control lines within a wellbore, comprising:

providing a downhole tool having an enclosed line housing therethrough;

expanding the downhole tool into the wellbore, thereby radially moving the line housing through an annulus between the downhole tool and the wellbore;

protecting the one or more control lines with the enclosed line housing during the expansion; and deforming the enclosed line housing upon expansion of the downhole tool to substantially seal the annulus.

11. The method of claim 10, further comprising substantially conforming the enclosed line housing to a shape of a wall of the wellbore upon expansion of the downhole tool to substantially seal the annulus.

* * * * *

UNITED STATES PATENT AND TRADEMARK OFFICE

CERTIFICATE OF CORRECTION

PATENT NO. : 6,932,161 B2
APPLICATION NO. : 09/964160
DATED : August 23, 2005
INVENTOR(S) : John A. M. Cameron It is certified that error appears in the above-identified patent and that said Letters Patent is hereby corrected as shown below:

On the front page of the patent, Item (73), Assignee: Change "Weatherford/Lams, Inc." to --Weatherford/Lamb, Inc.--

Column 6, Claim 1, Line 3: Change "bass" to --base--

Signed and Sealed this

Twelfth Day of December, 2006

JON W. DUDAS
*Director of the United States Patent and Trademark Office*